United States Patent [19]

Dobashi

[11] Patent Number: 4,531,849

[45] Date of Patent: Jul. 30, 1985

[54] RIBBON FEED MECHANISM

[75] Inventor: Koichi Dobashi, Tamayama, Japan

[73] Assignee: Alps Electric Co., Ltd., Japan

[21] Appl. No.: 655,939

[22] Filed: Sep. 28, 1984

[30] Foreign Application Priority Data

Sep. 29, 1983 [JP] Japan ..... 58-149591[U]

[51] Int. Cl.[3] ..... B41J 33/04; B41J 33/22

[52] U.S. Cl. ..... 400/229; 400/236.2

[58] Field of Search ..... 400/229, 323, 194, 195, 400/196, 196.1, 207, 208, 208.1, 221, 221.2, 223, 236, 225, 221.1, 236.2; 74/29, 31, 33, 34

[56] References Cited

U.S. PATENT DOCUMENTS

| | | | |
|---|---|---|---|
| 915,037 | 3/1909 | Nickerson | 400/221 X |
| 3,990,564 | 11/1976 | Crump et al. | 400/194 X |
| 4,468,139 | 8/1984 | Hattori | 400/196 X |

FOREIGN PATENT DOCUMENTS

| | | | |
|---|---|---|---|
| 2821135 | 11/1979 | Fed. Rep. of Germany | 400/229 |
| 116249 | 9/1979 | Japan | 400/229 |
| 87593 | 7/1980 | Japan | 400/229 |

*Primary Examiner*—Edgar S. Burr

*Assistant Examiner*—Charles Pearson

*Attorney, Agent, or Firm*—Guy W. Shoup

[57] ABSTRACT

A ribbon feed mechanism for a printer comprises a carriage movably supported on a frame and movable with respect to a frame rack, the carriage supporting a ribbon cassette having a ribbon takeup shaft, a first drive gear held in mesh with the frame rack at all times, the first drive gear being movable with respect to the carriage, a second drive gear held in mesh with the frame rack at all times, the second drive gear being movable with respect to the carriage, an output gear spaced from the frame rack and coupled with the ribbon takeup shaft, and an idler gear held in mesh with the output gear at all times, the first drive gear being capable of mesh with the idler gear. The first drive gear is brought into mesh with the idler gear and the second drive gear is brought out of mesh with the output gear to rotate the output shaft in one direction when the carriage is moved in a first direction, and the second drive gear is brought into mesh with the output gear and the first drive gear is brought out of mesh with the idler gear to rotate the output shaft in said one direction when the carriage is moved in a second direction opposite to the first direction.

3 Claims, 7 Drawing Figures

RIBBON FEED MECHANISM

BACKGROUND OF THE INVENTION

The present invention relates to a ribbon feed mechanism for use in a printer, a typewriter or the like.

FIGS. 1 and 2 of the accompanying drawings illustrate a printer by way of example which incorporates a ribbon feed mechanism therein. More specifically, a carriage 2 is movably mounted on a frame 1 and supports thereon a wire-dot head 3 and a ribbon cassette 4 with a ribbon 5 wound therein, the ribbon 5 including an exposed stretch disposed in confronting relation to a platen 6. The carriage 2 with the ribbon cassette 4 mounted thereon is moved by a wire rope or the like (not shown) laterally along the platen 6 on the frame 1. Since the wire-dot head 3 can print desired characters or the like while it moves in opposite directions, the carriage 2 is shifted one step to the left or right each time one character is printed, and the ribbon 5 is fed along in one direction to bring an unused section of the ribbon 5 to a print position in front of the wire-dot head 3.

One conventional ribbon feed mechanism to be incorporated in the above printer is illustrated in FIGS. 3 and 4 of the accompanying drawings. A pair of upper and lower one-way clutches 14, 15 is mounted on a ribbon drive shaft 11. A pair of upper and lower pulleys 12, 13 is force-fitted over the outer peripheries of the one-way clutches 14, 15, respectively, with parallel wire ropes 16, 17 having single opposite turns wound around the pulleys 12, 13, respectively. When the wire rope 16 is pulled to the right to move the ribbon feed mechanism to the right, the upper pulley 12 and one-way clutch 14 rotate clockwise (FIG. 3) in unison. At this time, the one-way clutch 14 transmits driving power to rotate the ribbon drive shaft 11 clockwise about its own axis. The lower pulley 13 and one-way clutch 15 are rotated counterclockwise, during which time the one-way clutch 15 is disconnected to transmits no driving power to the ribbon drive shaft 11. Conversely, when the wire rope 17 is pulled to the left to move the ribbon feed mechanism to the left, the lower pulley 12 and one-way clutch 15 rotate clockwise in unison to rotate the ribbon drive shaft 11 clockwise about its own axis. The upper pulley 12 and one-way clutch 14 are rotated counterclockwise, whereupon the one-way clutch 14 remains disconnected. Accordingly, the ribbon drive shaft 11 rotates in one direction only as shown in FIG. 3 at all times when the ribbon feed mechanism is moved in different directions.

The conventional ribbon feed mechanism thus constructed is disadvantageous in that it must employ two expensive one-way clutches, and it is time-consuming and requires an increased number of assembling steps to train the wire ropes 16, 17 around the pulleys 12, 13, resulting in an increased cost of manufacture of the overall mechanism.

SUMMARY OF THE INVENTION

With the prior difficulties in view, it is an object of the present invention to provide a ribbon feed mechanism capable of feeding a ribbon without the use of one-way clutches and wire ropes.

According to the present invention, there is provided a ribbon feed mechanism for a printer, comprising a frame having a frame rack, a carriage movably supported on the frame and movable with respect to the frame rack, the carriage supporting a ribbon cassette having a ribbon takeup shaft, a first drive gear rotatably mounted on the carriage and held in mesh with the frame rack at all times, the first drive gear being movable with respect to the carriage, a second drive gear rotatably mounted on the carriage and held in mesh with the frame rack at all times, the second drive gear being movable with respect to the carriage, an output gear rotatably mounted on the carriage and spaced from the frame rack, the output gear being coupled with the ribbon takeup shaft, and an idler gear rotatably mounted on the carriage and held in mesh with the output gear at all times, the first drive gear being capable of mesh with the idler gear. The first drive gear is brought into mesh with the idler gear and the second drive gear is brought out of mesh with the output gear to rotate the output shaft in one direction when the carriage is moved in a first direction, and the second drive gear is brought into mesh with the output gear and the first drive gear is brought out of mesh with the idler gear to rotate the output shaft in said one direction when the carriage is moved in a second direction opposite to the first direction.

The above and other objects, features and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 5:
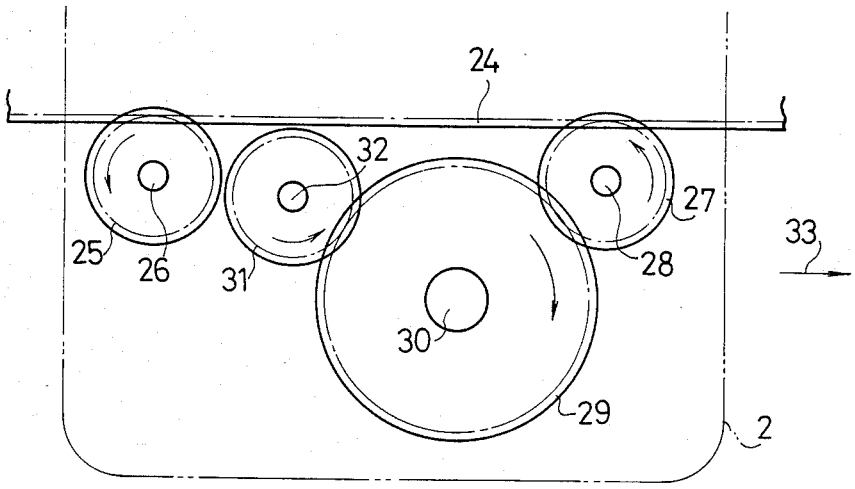
FIG. 5 is a schematic plan view of a ribbon feed mechanism according to the present invention, the view illustrating gears meshing in a mode for moving a carriage to the right.
Figure 6:
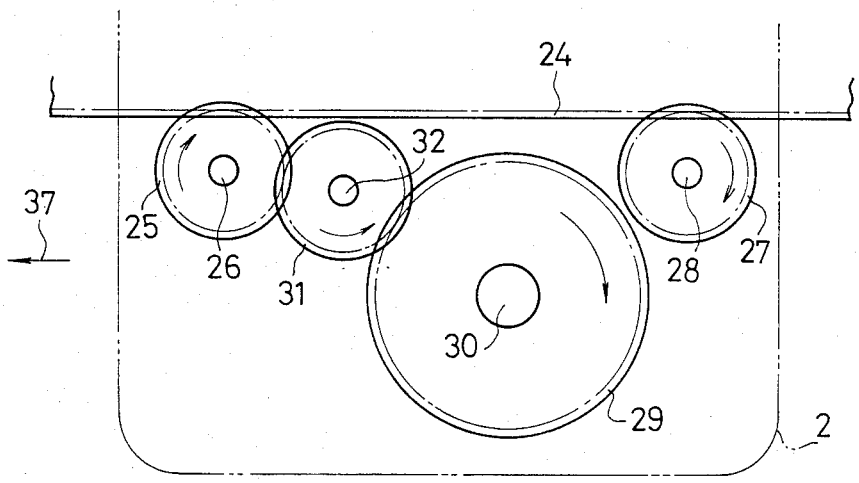
FIG. 6 is a view similar to FIG. 5, showing the gears meshing in a mode for moving the carriage to the left.
Figure 7:
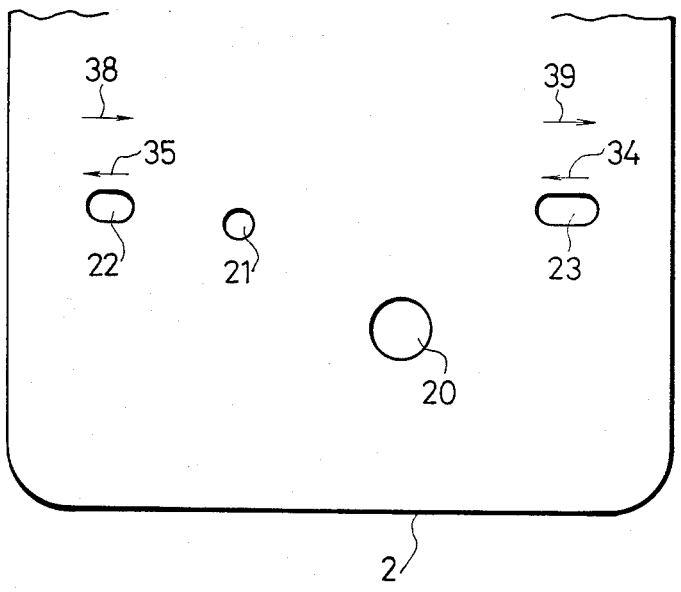
FIG. 7 is a fragmentary plan view of the carriage, illustrating a positional relationship between holes defined in the carriage.

FIGS. 5 through 7 are illustrative of a ribbon feed mechanism according to the present invention.

Figure 1:
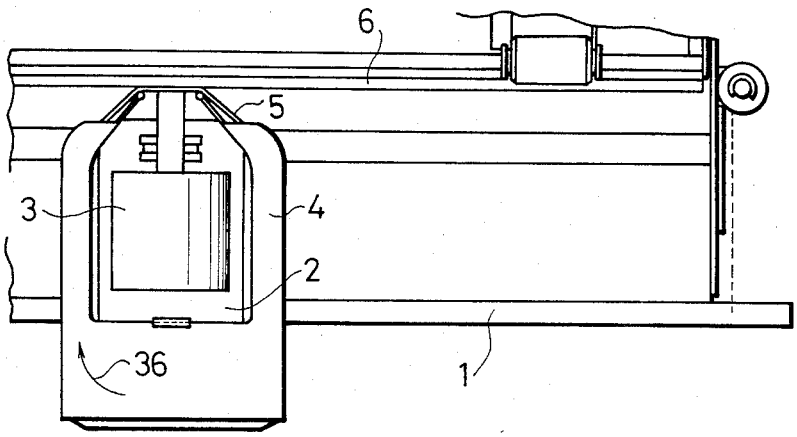
FIG. 1 is a fragmentary plan view of a printer in which a ribbon feed mechanism is incorporated, the view showing a carriage and surrounding parts.
Figure 2:
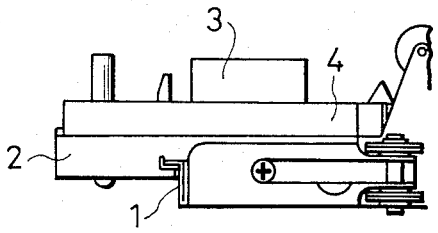
FIG. 2 is a fragmentary side elevational view of the printer shown in FIG. 1.
Figure 3:
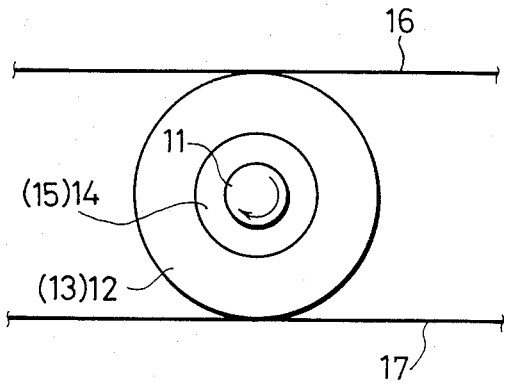
Fig.3 PRIOR ART
FIG. 3 is a plan view of a conventional ribbon feed mechanism.
Figure 4:
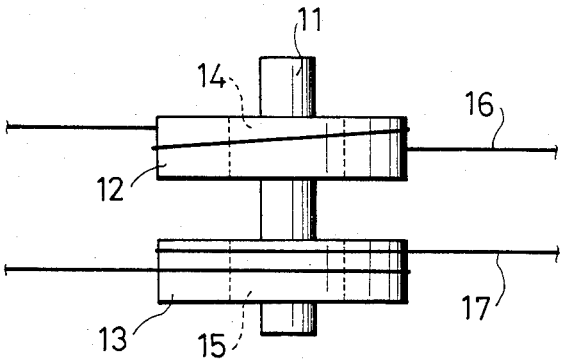
Fig.4 PRIOR ART
FIG. 4 is a front elevational view of the conventional ribbon feed mechanism illustrated in FIG. 3.

A carriage 2 has two round holes 20, 21 and two oblong holes 22, 23 as shown in FIG. 7. A frame has a frame rack 24 (FIGS. 5 and 6) extending axially along the platen 6 (FIG. 1). The frame rack 24 may comprise various means such as gear teeth formed directly on the frame or a toothed belt fixed to the frame.

The ribbon feed mechanism includes a first drive gear 25 rotatably held in mesh with the frame rack 24 at all times and movable along the frame rack 24, the first drive gear 25 being supported on the carriage 2 by a shaft 26 integrally formed with the first drive gear 25, for example, and disposed rotatably and displaceably in the oblong hole 22 in the carriage 2. The ribbon feed mechanism also includes a second drive gear 27 rotatably held in mesh with the frame rack 24 at all times and movable along the frame rack 24, the second drive gear 27 being supported on the carriage 2 by a shaft 28 integrally formed with the second drive gear 27, for example, and disposed rotatably and displaceably in the oblong hole 23 in the carriage 2.

An output gear 29 is disposed at a distance from the frame rack 24 and rotatably supported on an integral ribbon drive shaft 30 rotatably disposed in the round hole 20 in the carriage 2. The ribbon drive shaft 30 will be brought into mesh with a ribbon takeup shaft (not shown) on the ribbon cassette 4 (FIG. 1) when the ribbon cassette 4 is mounted on the carriage 2.

An idler gear 31 is rotatably held in mesh with the output gear 29 at all times and can mesh with the first drive gear 25. The idler gear 31 is supported on a shaft 32 which is integral with the idler gear 31, for example, and rotatably disposed in the round hole 21 in the carriage 2.

Each pair of the first drive gear 25 and the shaft 26, the second drive gear 27 and the shaft 28, the output gear 29 and the ribbon drive shaft 30, and the idler gear 31 and the shaft 32 may be integrally molded of synthetic resin, for example.

Operation of the ribbon feed mechanism thus constructed is as follows:

With the ribbon cassette 4 mounted on the carriage 2 as shown in FIG. 1, the carriage 2 is moved to the right in the direction of the arrow 33 in FIG. 5, whereupon the shaft 28 is moved relatively in the oblong hole 23 in the direction of the arrow 34 (FIG. 7) due to meshing engagement between the second drive gear 27 and the frame rack 24 and movement of the carriage 2, thus bringing the second drive gear 27 into mesh with the output gear 29. At this time, the second drive gear 27 is rotated counterclockwise as shown in FIG. 5. Simultaneously, the shaft 26 is moved relatively in the oblong hole 22 in the direction of the arrow 35 (FIG. 7) due to meshing engagement between the first drive gear 25 and the frame rack 24 and movement of the carriage 2, thus bringing the first drive gear 25 out of mesh with the idler gear 31. The first drive gear 25 is now rotated counterclockwise as shown in FIG. 5.

Accordingly, the second drive gear 27 is in mesh with the output gear 29 while the first drive gear 25 is out of mesh with the idler gear 31 in mesh with the output gear 29. Rotative power from the second drive gear 27 is now transmitted to the output gear 29 which is rotated clockwise as illustrated in FIG. 5. The clockwise rotation of the output gear 29 causes the ribbon takeup shaft on the ribbon cassette 4 (FIG. 1) to rotate clockwise. The ribbon 5 shown in FIG. 1 is now fed a prescribed length in the direction of the arrow 36 (FIG. 1) for allowing a character to be printed. Although the idler gear 31 and the first drive gear 25 are rotated counterclockwise during the above operation, they have no effect on the ribbon feeding.

When the carriage 2 is moved to the left in the direction of the arrow 37 (FIG. 6), meshing engagement between the first drive gear 25 and the frame rack 24 and movement of the carriage 2 cause the shaft 26 to move relatively in the oblong hole 22 in the direction of the arrow 38 (FIG. 7), whereupon the first drive gear 25 is in mesh with the idler gear 31 and the first drive gear 25 rotates clockwise. At the same time, meshing engagement between the second drive gear 27 and the frame rack 24 and movement of the carriage 2 cause the shaft 28 to move relatively in the oblong hole 23 in the direction of the arrow 39 (FIG. 7), whereupon the second drive gear 27 is out of mesh with the output gear 29 and the second drive gear 27 rotates clockwise.

Therefore, the first drive gear 25 is in mesh with the idler gear 31 and the second drive gear 27 is out of mesh with the output gear 29, whereupon rotative power from the first drive gear 25 is transmitted via the idler gear 31 to the output gear 29 which is rotated clockwise as shown in FIG. 6. The ribbon 5 can therefore be fed a prescribed length in the direction of the arrow 36 (FIG. 1).

While in the above embodiment the idler gear 31 is shown meshing with the first drive gear 25, the idler gear 31 may be positioned otherwise. For example, the idler gear 31 may be disposed for meshing engagement with the second drive gear 27. In such an alternative, the output gear 29 is rotated counterclockwise, and the ribbon 5 is fed a prescribed length in a direction opposite to the direction of the arrow 36 of FIG. 1.

Although each pair of the first drive gear 25 and the shaft 26, the second drive gear 27 and the shaft 38, and the idler gear 31 and the shaft 32 has been described as an integral construction, such a gear and shaft combination may comprise separate structures.

As described above, the ribbon feed mechanism according to the present invention can rotate the output gear in one direction only at all times through selection of gears meshing with the output gear dependent on the direction of movement of the carriage. As a consequence, the ribbon feeding can be performed without the use of one-way clutches and wire ropes. The gear train including output gear can be manufactured less costly than the one-way clutches and wire ropes. Since the gears can be assembled in position much more easily and in a smaller number of assembling steps than the wire ropes trained around the respective pulleys, the ribbon feed mechanism of the invention can be manufactured less costly than the conventional ribbon feed mechanism.

Although a certain preferred embodiment has been shown and described, it should be understood that many changes and modifications may be made therein without departing from the scope of the appended claims.

What is claimed is:

1. A ribbon feed mechanism for a printer, comprising:

(a) a frame having a frame rack;

(b) a carriage movably supported on said frame and movable with respect to said frame rack, said carriage supporting a ribbon cassette having a ribbon takeup shaft;

(c) a first drive gear rotatably mounted on said carriage and held in direct mesh with said frame rack at all times, said first drive gear being rotationally and translatably movable with respect to said carriage;

(d) a second drive gear rotatably mounted on said carriage and held in direct mesh with said frame rack at all times, said second drive gear being rotationally and translatably movable with respect to said carriage;

(e) an output gear rotatably mounted on said carriage and spaced from said frame rack, said output gear being coupled with said ribbon takeup shaft and;

(f) an idler gear rotatably mounted on said carriage and held in direct mesh with said output gear at all times, said first drive gear being movable into and out of mesh with said idler gear;

(g) wherein said first drive gear is brought into direct mesh with said idler gear and said second drive gear is brought out of mesh with said output gear to rotate said output shaft in one direction when said carriage is moved in a first direction, and said second drive gear is brought into direct mesh with said output gear and said first drive gear is brought out of mesh with said idler gear to rotate said output shaft in one direction when said carriage is moved in a second opposite to said first direction.

2. A ribbon mechanism according to claim 1, wherein said carriage has a pair of round holes and a pair of oblong holes, first drive gear, said second drive gear, said output gear, and said idler gear having respective shafts, said shafts of said first and second drive gears being rotatably and displaceably in said oblong holes, respectively, and said shafts of said output and idler gears being disposed rotatably in said round holes.

3. A ribbon mechanism according to claim 2, wherein each pair said first drive gear and the shaft thereof, said drive gear and the shaft thereof, said output gear and shaft thereof, and said idler gear and the shaft thereof integrally molded of synthetic resin.

* * * * *